US009840309B2

(12) United States Patent
Lisland et al.

(10) Patent No.: US 9,840,309 B2
(45) Date of Patent: Dec. 12, 2017

(54) MOORING ARRANGEMENT

(71) Applicant: SCANA OFFSHORE AS, Vestby (NO)

(72) Inventors: Torkjell Lisland, Drøbak (NO); Lars Even Nilssen, Son (NO)

(73) Assignee: SCANA OFFSHORE AS, Vestby (NO)

( * ) Notice: Subject to any disclaimer, the term of this patent is extended or adjusted under 35 U.S.C. 154(b) by 0 days.

(21) Appl. No.: 15/147,216

(22) Filed: May 5, 2016

(65) Prior Publication Data

US 2016/0325804 A1 Nov. 10, 2016

(30) Foreign Application Priority Data

May 7, 2015 (NO) ..... 20150565

(51) Int. Cl.
*B63B 21/18* (2006.01)
*B63B 21/50* (2006.01)
*B63B 21/16* (2006.01)

(52) U.S. Cl.
CPC ..... *B63B 21/50* (2013.01); *B63B 21/16* (2013.01); *B63B 21/18* (2013.01)

(58) Field of Classification Search
CPC ..... B63B 21/50; B63B 21/16; B63B 21/18
USPC ..... 114/293, 294
See application file for complete search history.

(56) References Cited

U.S. PATENT DOCUMENTS 5,441,008 A * 8/1995 Lange ..... B63B 21/50 114/179
7,926,436 B2 4/2011 Boatman et al.
8,069,805 B2 12/2011 De Baan et al.
8,770,039 B2 7/2014 Dang et al.
8,915,205 B2 12/2014 Miller et al.
2011/0258829 A1* 10/2011 Vanderbeke ..... E02B 17/027 29/428

FOREIGN PATENT DOCUMENTS

WO WO 2010107319 A1 * 9/2010 ..... F16L 1/203

OTHER PUBLICATIONS

U.S. Appl. No. 15/140,843, Lisland.

* cited by examiner

*Primary Examiner* — Stephen P Avila
(74) *Attorney, Agent, or Firm* — Winstead PC

(57) ABSTRACT

A mooring arrangement for a floating vessel includes a linear anchor winch and an elongate mooring arm. The mooring arm is coupled to a mooring arm bracket via an articulating joint and the arrangement is adapted to receive an anchor chain. The bracket is attached to the vessel at the gunwale of the vessel, so that the bracket at least partially extends above the deck of the vessel. The anchor winch is coupled to or integrated with said bracket.

8 Claims, 2 Drawing Sheets

MOORING ARRANGEMENT

FIELD OF THE INVENTION

The following invention relates to a mooring arrangement for floating vessels, and more particularly the arrangement coupling an anchor chain to the vessel. The invention is suitable both for mooring vessels that are moored at the same place for prolonged periods of time, e.g., over several years, such as production or storage vessels in the offshore oil and gas industry. However, the invention may also be used for mooring other types of vessels and for shorter periods of time, such as drilling vessels, workover platforms or other types of temporarily deployed floating vessels or structures that are frequently moved from site to site.

BACKGROUND

A common arrangement of tension and chain stopper device for vessel anchoring chains is shown in FIG. 1. This comprises a fairlead 21 attached to the side of the vessel 22 close to a bottom 23 of the vessel 22. It also comprises a chain stopper 24 arranged at a deck 25 level of the vessel. A chain 31 extends from a seabed anchor (not shown) through the fairlead 21 and to the chain stopper 24. The arrangement also comprises a chain adjusting device 26, which in turn comprises a trolley 27 that is moveable on tracks 28. A chain winch 33 is placed in the trolley 27. Next to the trolley 27 is a chain container 30 for storing non-active pull chain.

The system comprises a plurality of fairleads 21 and chain stoppers 24. The trolley 27 is moveable between the chain stoppers 24 to tighten or slacken the chains according to needs. When a chain is to be, e.g., tightened, the trolley 27 will be brought to the chain stopper 24 holding this chain, a pull chain 22 stored in the chain container (there is one pull chain for each mooring chain) is fed over a turn down wheel 29 and connected to the mooring chain 31. Then the anchor winch 29 is activated, the chain stopper 24 released and the anchor chain 31 is pulled to the required tension.

This process has to be repeated as the anchor chain slackens due to stretching of the chain, wear of the chain, displacement of the anchor of because the vessel has to be moved short distances without the need to change the anchor positions. The multiple chains (typically, the vessel is moored by 5 or 6 chains arranged at 4 separate locations, such as one location at each side of the bow and one location at each side of the stern) should have substantially the same tension.

SUMMARY

Consequently, the present invention aims to simplify the re-tensioning of the anchor chains, save deck space and improve safety. This has been achieved by a mooring arrangement for floating vessels comprising a linear anchor winch and elongate mooring arm, said mooring arm being coupled to a mooring arm bracket via an articulating joint and said arrangement being adapted to receive an anchor chain. The invention being distinctive in that said bracket is attached to the vessel at the gunwale of the vessel, so that the bracket at least partially extends along the deck of the vessel and is adapted to at least partly extend along a hull (5) of the vessel (6) said anchor winch is coupled to or integrated with said bracket at the deck of the vessel.

This provides a mooring arrangement that is simpler with fewer components and that occupies a smaller deck space than previous mooring arrangement. The bracket also provides an easy and space-saving unit compared to the prior art mooring arrangement.

Preferably, the anchor winch is arranged on the deck of the vessel.

This also provides a winch that has a low height and it is possible to put modules above the winch.

Preferably, the anchor winch has a traction direction along the surface of the deck perpendicular to the gunwale of the vessel.

This provides an arrangement where the chain is extending in a plane perpendicular to the gunwale that reduces the bending forces on the chain.

Preferably, the winch is moveably along the deck so that it can be positioned in line with a selected one of a plurality of fairlead arrangements.

This provides an arrangement where the winch is moveable can may serve a plurality of fairlead arrangements.

Preferably, the winch is moveable on a set of tracks that extends substantially in parallel with the gunwale.

This provides an arrangement where it easy to move the winch from one fairlead arrangement to the next.

Preferably, there is a chain stopper arrangement integrated in the fairlead arrangement.

This provides an arrangement where the chain can be tensioned and locked or held in a suitable position. When the chain stoppers (8) are activated, it is not possible for the chain to move in the traction direction along the mooring arrangement.

Preferably, the coupling between the bracket and the fairlead arrangement is situated outside of the gunwale.

This provides an arrangement that saves space on the deck of the vessel.

BRIEF DESCRIPTION OF THE DRAWINGS

The invention will now be described, referring to the accompanying drawing, in which.

DETAILED DESCRIPTION

Referring again to FIG. 1, consequently, the chains will have to be re-tensioned with intervals ranging from a few months to a year, depending on the age of the mooring system and local conditions.

If the moorings get too slack, the vessel will tend to move more. This is not only uncomfortable to the persons on board the vessel, but may also pose a risk to damaging equipment on board and if a heavy storm occurs, the vessel itself may be in danger of becoming adrift.

It is of course possible to use one anchor winch for each chain, but this only serves to increase the costs and complicates the clearing of deck space when the winches are not in use.

The known arrangement of winch trolley and chain container is heavy and will increase the weight of the vessel and thereby reduce the loading capacity.

There is therefore a great need for a simpler arrangement for re-tensioning the mooring chains.

There is also a need for an arrangement that occupies a smaller deck space.

By arranging the winch moveable, so that it can be positioned above a selected one of a plurality of fairlead arrangements, such as moveable on a set of tracks, one winch can serve all the fairlead arrangements. Another embodiment is to arrange one winch above each fairlead arrangement.

In one embodiment, the winch is a linear winch. A linear winch is small in height and powerful in tension force. The winch also has a traction direction parallel with the deck, which provides a winch with low height. It is thereby possible to arrange a set of columns with an auxiliary deck at a short distance above the winch.

Figure 2:
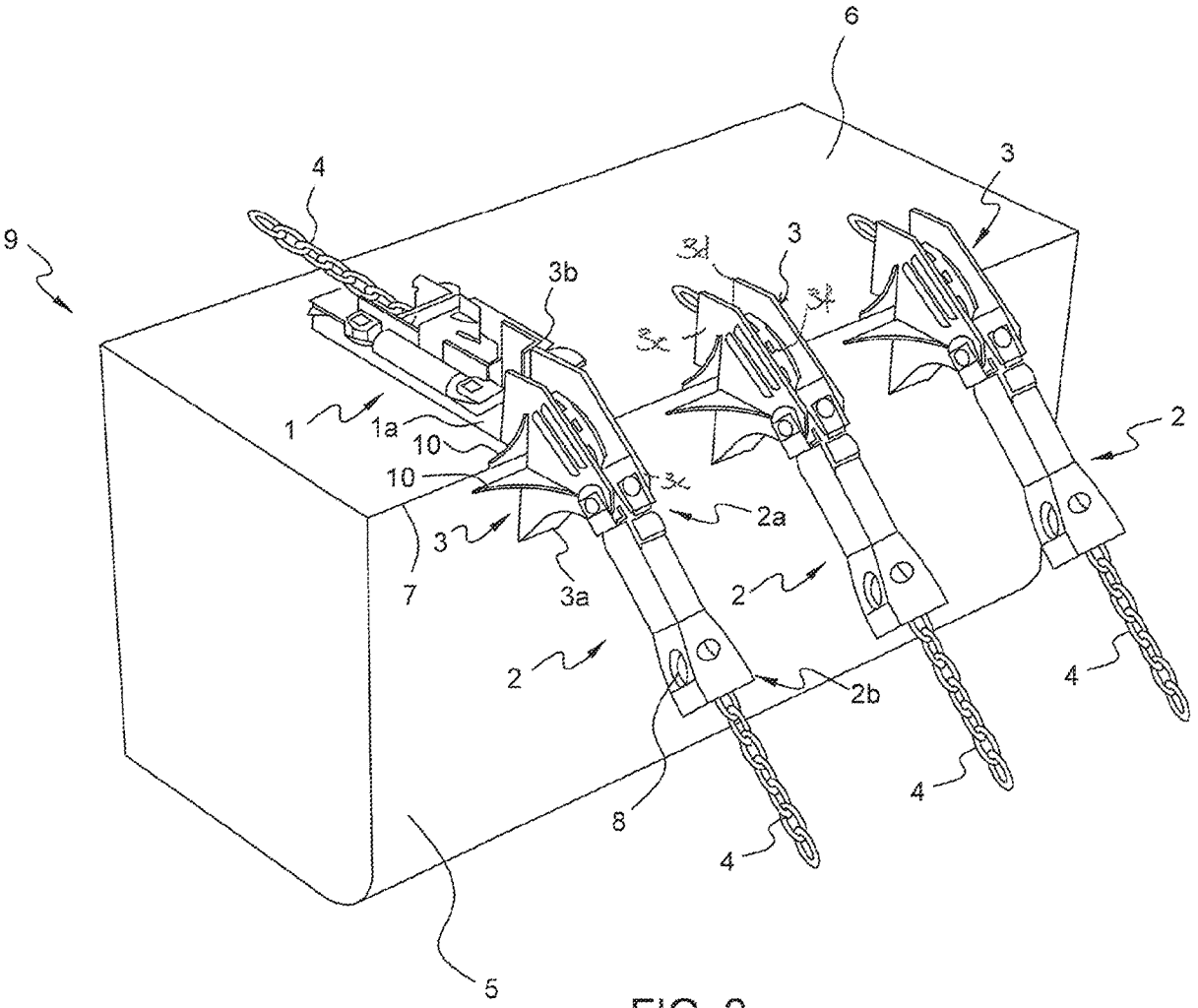
FIG. 2 shows an arrangement according to the present invention in a perspective view as a first anchor chain is being tensioned.

The mooring arrangement of the present invention is shown in FIG. 2. It is shown in a perspective view in the in the figure, whereby a part of a hull 5 and a deck 6 of a vessel is shown.

A gunwale 7 is defined as the line formed by the intersection of the side of the vessel hull 5 and the main deck of the vessel 6. If the vessel is a platform, the gunwale 7 is the equivalent line formed at the edge of the platform deck. The gunwale 7 is extending along the outside perimeter of the vessel 9 or platform.

There is arranged at least one bracket 3 at the gunwale 3 of the vessel 9. In FIG. 2 three brackets are shown, but the number can be different from this. Each bracket 3 is fixedly attached to the vessel 9, such as by welding or bolting. Each bracket 3 can also be reinforced by one or several wedges 10 arranged perpendicular on each side of the bracket 3 as shown in the FIG. 2.

In the FIG. 2, the bracket having a L-shaped part facing the vessel 9 with a first part 3*a* extending along the surface of the hull 7 and a second part 3*b* extending along the surface of the deck 6.

A fairlead or mooring arm 2 is coupled to the bracket at a coupling point 3*c*, which is preferably at the first part 3*a* of the bracket 3 situated outside of the deck of vessel 6. A second part 3*b* of the bracket extends above the deck of the vessel. The second part 3*b* having end portions 3*d*. Said end portions 3*d* extending perpendicular to the deck of the vessel. This end portions 3*d* is adapted to match the linear winch as shown in FIG. 2 to give support to the linear winch.

The FIG. 2 shows the mooring arm unit or fairlead 2. This is shaped as an elongated member pivotably attached to the bracket 3 at a first upwardly facing end 2*a*. The fairlead 2 has a second end 2*b*, which in use extends downwardly at outwardly an angle relative to the hull 5. An anchor chain 4 extends from an anchor (not shown) at the seabed, through the fairlead 2. The chain 4 extends further over the bracket 3.

At or near the second end 2*b* of the fairlead 2 there is arranged a chain stopper arrangement 8. This could be a similar chain stopper arrangement as described in the Norwegian application NO20150515, filed 29 Apr. 2015 by the same applicant, which is incorporated herein by reference.

The chain stopper arrangement is adapted to pivot about a substantially first axis and a second pivot hinge that enables the mooring unit to pivot about a second axis. The first and second pivot axis are arranged in substantially the same plane.

At the surface of the deck 3 there is arranged at least one winch 1 inside a winch frame 1*a*. This winch 1 is arranged close to the second part 3*b* of the bracket. The winch 1 is arranged adjacent the bracket 3 so that the frame of the winch 1*a* and the bracket 3 are in abutting relationship. The frame of the winch 1*a* may be an extension of the bracket 3 perpendicular to the gunwale 7 along the surface of the deck 6. The winch 1 and the winch frame 1*a* is arranged on the surface of deck 6 so that its traction direction is parallel with the deck surface and generally perpendicular to the gunwale 7.

The winch frame 1*a* and the bracket 3 could be two separate parts that are shaped to mate at the proximity of each other. The bracket 3 thereby forms a support for the winch frame 1*a*, so that the traction force of the winch 1 is transferred to the bracket 3. The bracket 3 must be solidly fixed to the vessel 9 to take up the mooring forces. The winch frame 1*a* do not need be fixedly connected to the deck 6 of the vessel 9, and it is therefore easier to arrange the winch 1 to be moveable between the different mooring arrangements. The winch frame 1*a* may be just leaning on the bracket 3 or may be removably attached to the bracket 3.

In the FIG. 2 the second part of the bracket is shaped as two linear end portions 3*b* extending upwardly from the deck of the vessel. The linear end portions 3*b* are arranged at the proximity of the winch to support the winch 1. The bracket could also have only one end portion to support the deck of the vessel.

In certain embodiments of the invention the winch frame 1*a* may be fixedly attached to the bracket 3 or even integrated with the bracket 3. This is a viable embodiment if the winch 1 is not to be moveable.

The bracket 3 in the figure comprising two oppositely arranged plates 3*e* spaced by a chain transporting element 3*f*. The chain is adapted to pass over the chain transporting element 3*f* between the plates 3*e*.

The chain 4 extends from the bracket 3 through the winch 1 to a chain store compartment (not shown) or similar arrangement.

The winch 1 is preferable a linear winch in order to reduce the height of the arrangement on the deck of the vessel.

Several fairleads 2 and brackets 3 could be arranged side by side next to each other and the winch 1 could in an embodiment of the invention be arranged on a rail system (not shown) arranged parallel to the gunwale 7. Thereby the winch 1 can be moved between the fairlead arrangements.

When the anchor chains are to be tensioned, the winch 1 is moved and placed next to a selected fairlead arrangement 2. The chain 4 from the fairlead arrangement 2 and the chain 4 from the winch 1 are connected together in a per se known way.

When the chain 4 has been tensioned to the required tension, the winch operation is stopped, the chain stoppers 8 are activated, and the chain 4 could be severed from the bracket so that the winch 1 and winch frame 1*a* could be moved to the next fairlead arrangement 2 where the process is repeated. Optionally there could be arranged one winch 1 to each fairlead 2 to perform the tensioning operation as described above.

Figure 1:
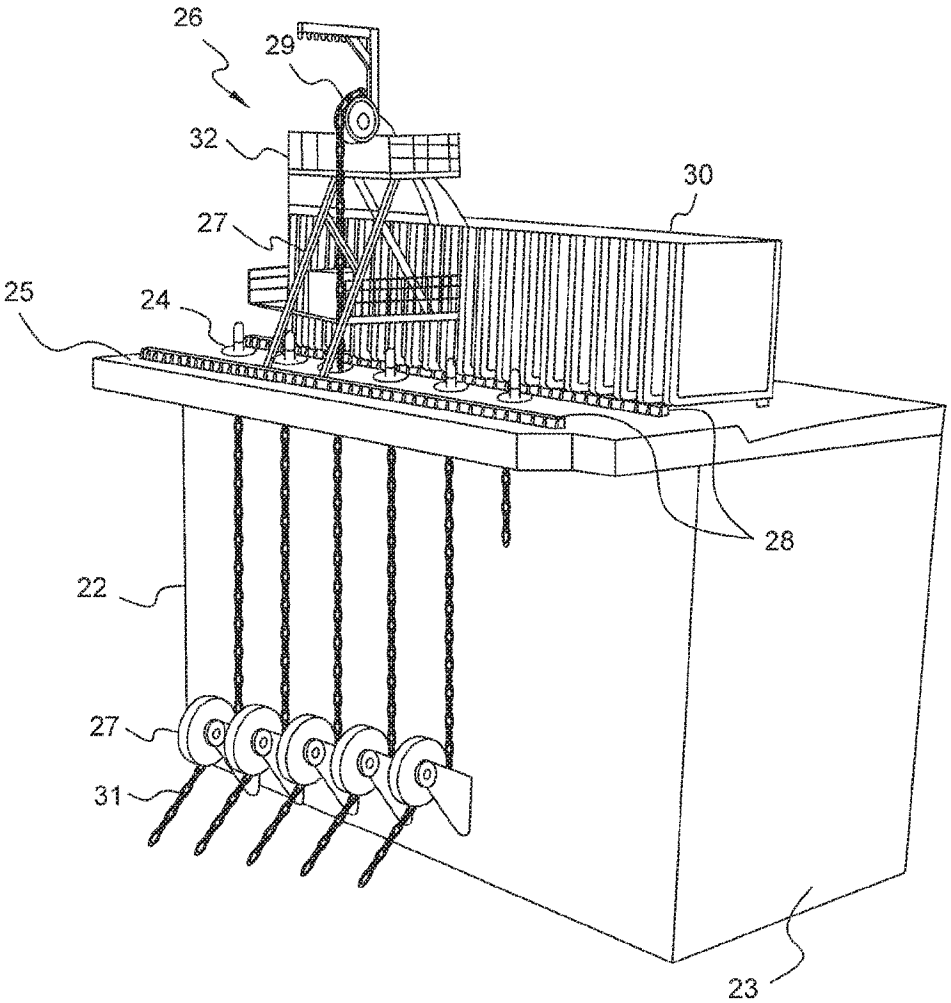
FIG. 1 shows a prior art mooring arrangement.

The arrangement according to the invention will occupy a smaller portion of the vessel deck than the portion of the deck occupied by the conventional mooring system of FIG. 1.

This leads to a winch 1 that has a low height and that it is possible to put modules for instance on piles above the winch 1.

The chain 4 is extending in the same direction from the bracket 3 through the winch 1. This reduces the bending forces of the chain.

It also eliminates the need for an intermediate arrangement like a pulley or similar arrangement.

The bracket 3 is arranged cantilevered and the coupling to the fairlead 4 or mooring arm 2 is outside the side of the vessel. The arrangement is thus a space saving arrangement compared to previous arrangements.

The present invention has been described with reference to some preferred embodiments and a drawing for the sake of understanding only and it should be clear to persons skilled in the art that the present invention includes all legitimate modifications within the ambit of what has been described hereinbefore and claimed in the appended claims.

The invention claimed is:

1. A mooring arrangement for a floating vessel, the mooring arrangement comprising:

a linear anchor winch situated at or near a deck of the vessel;

a mooring arm bracket coupled to the linear anchor winch; and an elongate mooring arm having a chain stopper, the elongate mooring arm being coupled to the mooring arm bracket via an articulating joint, said arrangement being adapted to receive an anchor chain wherein the bracket is attached to the vessel at a gunwale of the vessel, so that the bracket is adapted to at least partially extend along a deck of the vessel and is adapted to at least partly extend along a hull of the vessel, the anchor winch is coupled to or integrated with the bracket at the deck of the vessel.

2. The mooring arrangement according to claim 1, wherein the anchor winch is adapted to be arranged on the deck of the vessel.

3. The mooring arrangement according to claim 1, wherein the anchor winch has a traction direction along a surface of the deck perpendicular to the gunwale of the vessel.

4. The mooring arrangement according to claim 1, wherein the winch is movably along the deck so as to be positioned in line with a selected one of a plurality of fairlead arrangements.

5. The mooring arrangement according to claim 1, wherein the winch is moveable on a set of tracks that extends substantially in parallel with the gunwale.

6. The mooring arrangement according claim 4, wherein the fairlead arrangement comprising a chain stopper arrangement.

7. The mooring arrangement according to claim 4, wherein the bracket having a coupling for coupling to the fairlead arrangement, the coupling being situated outside of the gunwale.

8. The mooring arrangement according to claim 1, wherein the bracket having end portions for supporting the winch.

* * * * *